United States Patent [19]

Carley

[11] Patent Number: 4,618,799

[45] Date of Patent: Oct. 21, 1986

[54] FLASHLIGHT BULB

[75] Inventor: James A. Carley, Rolling Hills, Calif.

[73] Assignee: Carley, Torrance, Calif.

[21] Appl. No.: 606,657

[22] Filed: May 3, 1984

[51] Int. Cl.[4] ..... H01J 5/48

[52] U.S. Cl. ..... 313/318; 313/315

[58] Field of Search ..... 313/318, 315

[56] References Cited

U.S. PATENT DOCUMENTS

| | | | |
|---|---|---|---|
| 401,444 | 4/1889 | Wightman | 313/315 |
| 1,158,928 | 11/1915 | Keyes | 313/318 |
| 1,951,423 | 3/1934 | Korengold | 313/318 |
| 2,235,515 | 3/1941 | Carpenter | 313/318 |
| 2,556,059 | 6/1951 | Braundorff | 313/271 |
| 3,027,481 | 3/1962 | Baber et al. | 313/318 |
| 3,209,188 | 9/1965 | Freeman | 313/318 |
| 4,145,631 | 3/1979 | Saito | 313/318 |

*Primary Examiner*—Harold Dixon

*Attorney, Agent, or Firm*—Daniel C. McKown

[57] ABSTRACT

An improved flashlight bulb in which excessive wandering of the glass envelope with respect to the filament during the sealing phase of manufacture is prevented by fusing a spacer bead to the wires supporting the filament, the diameter of the spacer bead being only slightly less than the inside diameter of the glass envelope, so that lateral movement of the glass envelope with respect to the filament is limited by the spacer bead. In the preferred embodiment, the spacer bead is an elongated bead that extends from approximately 0.040 inch of the filament to the base of the bulb. In an alternative embodiment, the wires within the bulb are fused to a sealing bead which is spaced from the spacer bead. In yet another alternative embodiment, a stack of beads extends from a point near the filament to the base of the flashlight bulb. Because the filament lies on the axis of the cylindrical envelope in flashlight bulbs produced in accordance with the invention, the flashlight bulbs greatly improve the pointing and beam forming abilities of most flashlights.

1 Claim, 7 Drawing Figures

FLASHLIGHT BULB

BACKGROUND OF THE INVENTION

1. Field of the Invention The present invention is in the field of incandescent light bulbs and in particularly relates to a structure for a flashlight bulb.

2. The Prior Art

In one well-known technique for constructing flashlight bulbs, a pressed and sintered glass bead is used. The bead typically is cylindrical in shape and two holes extend through it in the axial direction. Wires are inserted into these holes, and fused to the bead. The wires extend in the axial direction on both sides of the bead. A filament is then welded to the ends of the wires. This intermediate structure is then placed in a fixture and a cylindrical glass envelope that is closed at one end is placed over the filament so that the rim of the open end of the glass envelope rests against the bead. At this stage, the structure is placed in a vacuum chamber and heat is applied to bond the glass envelope to the glass bead.

The applied heat causes the glass envelope to soften and to seal against the bead. Because the glass envelope is softened and because it must collapse against the bead in order to form a seal, it is not uncommon for the cylindrical envelope to assume a position that is not parallel to the direction of the wires and not parallel to the axis of the cylindrical bead. As a result, the filament is not centered within the envelope, and does not lie on the axis of the bulb.

This displacement of the filament from its correct position is very undesirable, particularly in applications where the reflector (or other apparatus used with the flashlight bulb) positions the flashlight bulb with respect to the reflector. The filament will then be off axis with respect to the reflector. This has the undesirable result that the flashlight beam will not be parallel to the axis of the flashlight. In addition, because the filament is not located on the axis of the reflector, certain optical aberrations that are inherent in the reflector are greatly aggravated. The beam that is produced does not form as small a spot, and the difference in illumination can very well be three to one with a filament that is centered versus a non-centered filament. In short, the lateral displacement of the filament from its correct position with respect to the reflector has serious consequences for the ability of the flashlight to form a small, bright spot that is located on the axis of the flashlight, where the user expects it to be.

The present invention relates to a flashlight bulb structure that results in the filament being located on the axis of the reflector, and accordingly solves the problems associated with the flashlight bulbs of the prior art.

SUMMARY OF THE INVENTION

A major objective of the present invention is to provide a structure for a flashlight bulb that results in the filament being located on the axis of the envelope so that the flashlight can form a well-collimated beam that is coaxial with the axis of the flashlight.

In accordance with the present invention, this is accomplished by providing a glass bead that extends almost to the filament, so that it serves to prevent the glass envelope from wandering as it softens to form a bond with the glass bead.

As in the prior art, the bead is formed of a pressed and sintered glass bead that includes axially-directed holes running through it for the wires. In the preferred embodiment, the bead is abnormally long compared to beads of the prior art, and is cylindrically shaped. The open end of the glass envelope is slipped over the glass bead and the envelope fits snugly over the elongated glass bead. In this manner, the envelope is rather accurately aligned with the axis of the bead, preventing the envelope from wandering as it softens during the bonding operation. This assures that the filament will be on the axis of the envelope after the envelope has been bonded to the bead.

Because the filament is on the axis of the envelope in the flashlight bulb of the present invention, the use of the flashlight bulb of the present invention results in a beam that is much better collimated and much more coaxial with the axis of the reflector.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
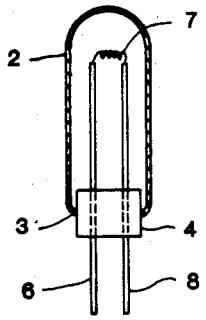
FIG. 1 is a side elevation view showing a properly constructed flashlight bulb of the prior art.
Figure 2:
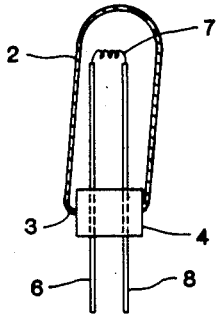
FIG. 2 is a side elevation view showing a defective flashlight bulb of the prior art.
Figure 3:
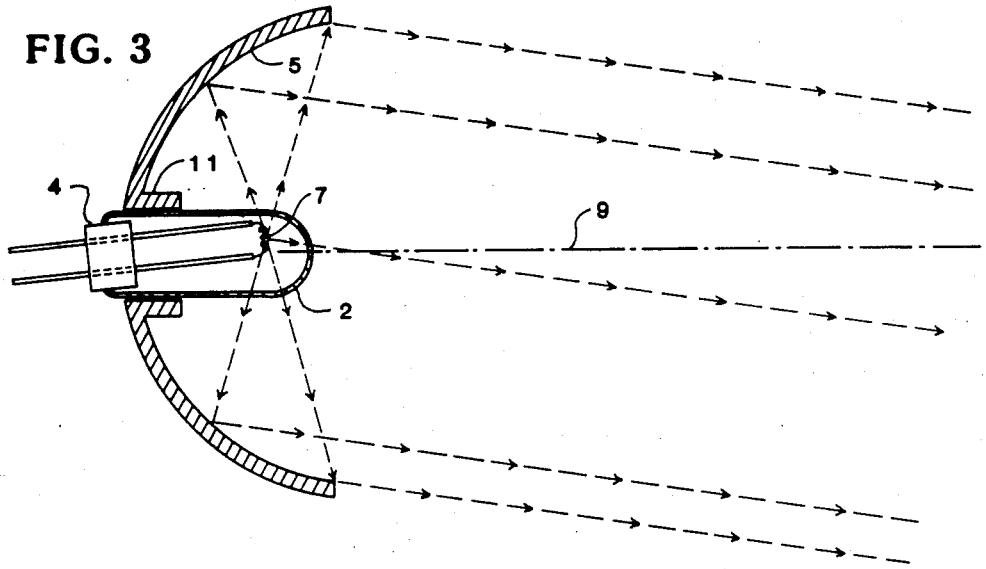
FIG. 3 is an optical diagram illustrating how the defective structure of the flashlight bulb of FIG. 2 affects the beam of a flashlight.

FIG. 1 shows the structure of a flashlight bulb properly constructed in accordance with the prior art. FIG. 2 shows a type of manufacturing defect that sometimes occurs when flashlight bulbs are produced in accordance with the prior art. FIG. 3 shows that for some applications, the use of a defectively formed bulb such as that shown in FIG. 2 has an undesirable effect on the beam formed by the reflector of a flashlight or similar device.

It is an object of the present invention to avoid the undesirable effects shown in FIG. 3 by an improvement to the structure of the flashlight bulb. FIGS. 4–7 show various embodiments of flashlight bulbs constructed in accordance with the present invention.

The process of manufacturing the prior art flashlight bulb of FIG. 1 begins with a short cylindrical pressed and sintered glass bead 4. Wires 6, 8 are inserted through holes that extend axially through the bead 4, and then the assembly is heated to fuse the bead 4 to the wires 6, 8. Thereafter, a filament 7 is welded to the wires 6, 8.

Next, the intermediate structure thus formed is placed in a fixture that holds the bead 4 with the wires 6, 8 extending vertically. The fixture includes a vacuum manifold for drawing a vacuum within the envelope 2 and further includes heating means for heating the rim 3 of the open end of the cylindrical glass envelope 2. After the vacuum has been pulled, the heat is applied, and the heat causes the rim 3 to soften and to bond to the bead 4 so as to form a vacuum seal. It is during this operation that the envelope 2 sometimes becomes misaligned with respect to the axis of the bead 4. The softening of the glass envelope 2 under the influence of the applied heat may permit the envelope 2 to wander to an off-axis position such as that shown in FIG. 2. After the seal has been formed, and the heat removed, the flashlight bulb permanently remains in the configuration shown in FIG. 2.

FIG. 2 shows in an exaggered form the displacement of the filament 7 from the axis of the cylindrical envelope 2.

This displacement of the filament from the axis of the glass envelope can have surprisingly serious consequences with respect to the beam-forming and directing capabilities of the flashlight.

As illustrated in the diagram of FIG. 3, where a portion 11 of the reflector 5 is used to mount the flashlight bulb with the axis of the glass envelope coincident with the axis 9 of the reflector 5, the filament 7 will necessarily be displaced from the optical axis with the following consequences.

As is well known from elementary optics, when the filament is displaced above the axis 9, the beam is pointed downwardly as shown in FIG. 3. Likewise, if the filament is displaced below the axis 9, the beam will be inclined upward with respect to the axis 9. In either case, the beam axis will not coincide with the axis of the flashlight, and the user will find that the beam does not point in the same direction that the flashlight is pointing. This can be rather disconcerting for the user, particularly in an emergency situation.

Another undesirable effect that results from the displacement of the filament 7 from the axis 9 of the reflector is that the optical aberrations produced by the reflector always increase with the displacement of the filament from the axis 9. For some of the aberrations, the magnitude of the aberration is proportional to the cube of the displacement of the filament from the axis. Accordingly, displacement of the filament 7 from the axis 9 causes the beam to be defocused, so that it becomes impossible to produce a desired small spot of light on a distant object. The larger spot of light results in lower illumination of the object, whereas higher illumination is desired.

Figure 4:
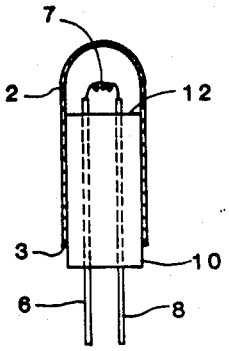
FIG. 4 is a side elevation view showing a preferred embodiment of the flashlight bulb of the present invention.
Figure 5:
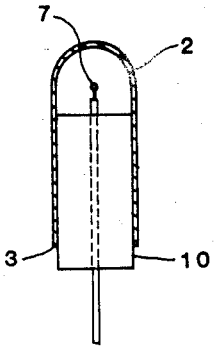
FIG. 5 is an end elevation view showing the embodiment of FIG. 4.

FIGS. 4 and 5 show a preferred embodiment of the present invention. In that embodiment, the improvement consists of using a much longer bead 10 compared to the bead 4 used in the prior art. The longer bead 10 extends almost the entire length of the wires 6, 8 within the glass envelope 2. The elongated bead 10, because its outside diameter approximates the inside diameter of the envelope, prevents the heat-softened envelope 2 from wandering laterally with respect to the filament 7. It has been found in practice that the outside diameter of the bead 10 should preferably be within 0.25 millimeters of the inside diameter of the glass envelope 2. Since the envelope cannot wander more than this radial distance from its desired position, the filament is maintained on the axis of the envelope.

In the best mode known for practicing the invention, the innermost end 12 of the bead 10 extends to within 1.0 millimeter of the filament 7. It was found that this arrangement has the added benefit of providing mechanical stability between the wires 6, 8, so that the filament 7 is less likely to be damaged by shock and vibration of the wires 6, 8, particularly when the filament is incandescent.

The flashlight bulb of the preferred embodiment of FIGS. 4 and 5 can be manufactured without modifying the fixture previously used in manufacturing the flashlight bulbs.

Figure 6:
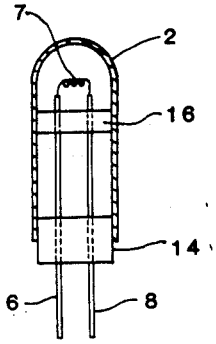
FIG. 6 is a side elevation view showing an alternative embodiment of the flashlight bulb of the present invention; and, FIG. 7 is a side elevation view showing a second alternative embodiment of the flashlight bulb of the present invention.

FIG. 6 shows an alternative embodiment of a flashlight bulb constructed in accordance with the present invention. In that embodiment, two beads are used. The sealing bead 14 is comparable to the bead 4 of the prior art. In this embodiment, the improvement is the use of a spacing bead 16 located along the wires 6, 8 near the filament 7.

In this embodiment, both the sealing bead 14 and the spacing bead 16 are fused to the wires 6, 8 prior to the welding of the filament 7 across the wires. Thereafter, the glass envelope 2 is placed over the assembly and fused to the sealing bead 14. The spacing bead 16 serves to prevent lateral displacement of the envelope 2 during the time that it is in a softened state.

Figure 7:
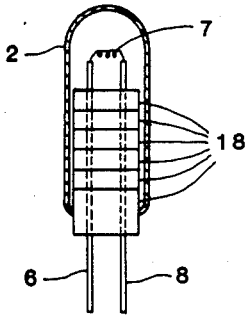

FIG. 7 shows a second alternative embodiment of the present invention in which the single bead 10 of FIG. 4 or the two beads 14, 16 of FIG. 6 are replaced by a stack of beads 18. In the construction of this embodiment, the beads 18 are stacked on the wires 6, 8, and then heat is applied to fuse the beads 18 together and to the wires 6, 8. This fusing action causes the individual beads 18 to fuse together, thereby forming a single elongated bead not unlike the bead 10 used in the preferred embodiment of FIG. 4.

Thus, there have been described a preferred embodiment and two alternative embodiments of an improved flashlight bulb in accordance with the present invention. In all of these embodiments, the presence of a spacer bead located near the filament on the wires 6, 8 and having an outside diameter that is less than 0.25 millimeters less than the inside diameter of the cylindrical glass envelope is employed. In all embodiments, the spacer bead extends longitudinally to less than 2.5 millimeters from the filament. The presence of the spacer bead prevents excessive wandering of the glass envelope with respect to the filament during the manufacturing stage in which the glass envelope is fused to the bead to form a vacuum seal.

The foregoing detailed description is illustrative of several embodiments of the invention, and it is to be understood that additional embodiments thereof will be obvious to those skilled in the art. The embodiments described herein together with those additional embodiments are considered to be within the scope of the invention.

What is claimed is:

1. A precision flashlight bulb in which a filament is accurately located within an envelope by limiting excessive lateral wandering of the envelope with respect to the filament during the sealing phase of manufacture, said precision flashlight bulb comprising:

a stack of cylindrical-shaped beads, said stack being cylindrical in shape and having a length that is at least as large as its diameter;

wires that pass through said stack to maintain its integrity and that extend from said stack in a direction parallel to its axis;

a filament connected between said wires; and, an envelope, cylindrical in shape, fitting snugly over said stack and extending almost the entire length of said stack, having a closed end that encloses said filament, and having an open end that is joined to said stack, whereby the snug fit of said envelope on said stack prevents said envelope from wandering laterally as the open end of said envelope is joined to said stack.

* * * * *